US011158224B2

(12) United States Patent
Li et al.

(10) Patent No.: US 11,158,224 B2
(45) Date of Patent: Oct. 26, 2021

(54) START SIGNAL GENERATION CIRCUIT, DRIVING METHOD AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Feng Li, Beijing (CN); Baoqiang Wang, Beijing (CN); Qiujie Su, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 698 days.

(21) Appl. No.: 16/077,992

(22) PCT Filed: Feb. 22, 2018

(86) PCT No.: PCT/CN2018/076976

§ 371 (c)(1),
(2) Date: Aug. 14, 2018

(87) PCT Pub. No.: WO2018/157751

PCT Pub. Date: Sep. 7, 2018

(65) Prior Publication Data

US 2021/0272492 A1 Sep. 2, 2021

(30) Foreign Application Priority Data

Mar. 2, 2017 (CN) ..... 201710119977.9

(51) Int. Cl.
*G09G 3/20* (2006.01)

(52) U.S. Cl.
CPC ..... *G09G 3/20* (2013.01); *G09G 2300/0842* (2013.01); *G09G 2310/08* (2013.01)

(58) Field of Classification Search
CPC ..... G09G 3/3677; G09G 2310/0286
See application file for complete search history.

(56) References Cited

U.S. PATENT DOCUMENTS 10,431,176 B2 * 10/2019 Zeng ..... G02F 1/13306
2012/0188210 A1 * 7/2012 Zhang ..... G09G 3/3677 345/204

(Continued)

FOREIGN PATENT DOCUMENTS

CN 104882111 A 9/2015
CN 105609135 A 5/2016
CN 106875886 A 6/2017

OTHER PUBLICATIONS

International Search Report and Written Opinion for Application No. PCT/CN2018/076976, dated May 3, 2018, 10 Pages.

*Primary Examiner* — Sepehr Azari
(74) *Attorney, Agent, or Firm* — Brooks Kushman P.C.

(57) ABSTRACT

A start signal generation circuit, a driving method and a display device are provided. The start signal generation circuit includes: a pull-down node control sub-circuit; a pull-up control node control sub-circuit, configured to control a potential of the pull-up control node under the control of voltage signals from a first clock signal input terminal, a second clock signal input terminal, and the $2n^{th}$ clock signal input terminal; a pull-up node control sub-circuit; a storage sub-circuit, connected between the pull-up node PU and a start signal output terminal; and a start signal output sub-circuit, where n is an integer larger than 1, and smaller than or equal to N, N is an integer larger than 1.

12 Claims, 3 Drawing Sheets

(56) References Cited

U.S. PATENT DOCUMENTS

| | | | | |
|---|---|---|---|---|
| 2014/0198023 | A1 | 7/2014 | Hsu | |
| 2014/0346520 | A1 | 11/2014 | Kim et al. | |
| 2015/0187312 | A1* | 7/2015 | Dai | G09G 3/3648 345/213 |
| 2015/0339981 | A1* | 11/2015 | Liu | G09G 3/3225 345/212 |
| 2016/0042693 | A1* | 2/2016 | Cao | G09G 3/3258 345/212 |
| 2016/0133211 | A1* | 5/2016 | Ma | G09G 3/20 345/205 |
| 2016/0133337 | A1* | 5/2016 | Gu | G09G 3/00 377/64 |
| 2016/0189799 | A1* | 6/2016 | Cao | G11C 19/287 377/64 |
| 2018/0068628 | A1* | 3/2018 | Xiao | G09G 3/3677 |
| 2018/0144677 | A1* | 5/2018 | Zhang | G09G 3/2092 |
| 2018/0301101 | A1* | 10/2018 | Hu | G11C 19/28 |
| 2019/0051263 | A1* | 2/2019 | Wang | G09G 3/3677 |

* cited by examiner

START SIGNAL GENERATION CIRCUIT, DRIVING METHOD AND DISPLAY DEVICE

CROSS-REFERENCE TO RELATED APPLICATION APPLICATIONS

This application is the U.S. national phase of PCT Application No. PCT/CN2018/076976 filed on Feb. 22, 2018, which claims priority to Chinese Patent Application No. 201710119977.9 filed on Mar. 2, 2017, which are incorporated herein by reference in their entireties.

TECHNICAL FIELD

The present disclosure relates to the field of display driving technology, in particular to a start signal generation circuit, a driving method and a display device.

BACKGROUND

In an existing GOA (Gate On Array) circuit, a single line is required to be arranged on the array substrate to provide a start signal STV for the gate drive sub-circuit, and an existing line cannot be used to provide such signal. Therefore, an additional start signal output terminal is necessary to provide the start signal, so that a corresponding start signal line needs to be increased, and space for the start signal output terminal and the start signal line is increased.

SUMMARY

In one aspect, the present disclosure provides in some embodiments a start signal generation circuit for providing a start signal to a Gate on Array (GOA) circuit, wherein the GOA circuit is connected to 2N clock signal input terminals, a first level input terminal and a second level input terminal, N is an integer larger than 1, the start signal generation circuit includes: a pull-down node control sub-circuit, connected to the pull-down node and the pull-up node respectively, and configured to control a potential of the pull-down node under the control of voltage signal(s) from the pull-up node; a pull-up control node control sub-circuit, connected to a first clock signal input terminal, a second clock signal input terminal, a $2n^{th}$ clock signal input terminal, and a pull-up control node, configured to control a potential of the pull-up control node under the control of voltage signal(s) from the first clock signal input terminal, the second clock signal input terminal, and the $2n^{th}$ clock signal input terminal; a pull-up node control sub-circuit, connected to the pull-up node, the pull-up control node, the pull-down node, and a second clock signal input terminal, and configured to the potential of the pull-up node under the control of voltage signal(s) from the pull-up control node, the pull-down node and the second clock signal input terminal; a storage sub-circuit, connected between the pull-up node PU and a start signal output terminal; and a start signal output sub-circuit, connected to the pull-up node, the pull-down node, the second clock signal input terminal, the start signal output terminal, the first level input terminal and the second level input terminal, and configured to control the start signal output terminal to be connected to the first level input terminal or to control the start signal output terminal to be connected to the second level input terminal under the control of voltage signal(s) from the pull-up node, the pull-down node and the second clock signal input terminal.

In some embodiments, in a display period of each frame, a period of a clock signal from each clock signal input terminal is the same, and a current clock signal is delayed by T/2N from an adjacent previous clock signal.

In some embodiments, the pull-down node control sub-circuit is connected to the first level input terminal and the second level input terminal respectively, and configured to control the pull-down node to be connected to the second level input terminal when the potential of the pull-up node is at a first level, and control the pull-down node to be connected to the first level input terminal when the potential of the pull-up node is at a second level; the pull-up control node control sub-circuit is connected to the second level input terminal, and configured to control a pull-up control node to be connected to the first clock signal input terminal when the first clock signal input terminal inputs a first level, and the second clock signal input terminal and the $2n^{th}$ clock signal input terminal all input a second level, and to control the pull-up node to be connected to the second level input terminal when the second clock signal input terminal inputs a first level and/or the $2n^{th}$ clock signal input terminal inputs a first level.

In some embodiments, the pull-down node control sub-circuit comprises: a first pull-down node control transistor, a gate electrode of the first pull-down node control transistor being connected to the pull-up node, a first electrode of the first pull-down node control transistor being connected to the pull-down control node, a second electrode of the first pull-down node control transistor being connected to the second level input terminal; a second pull-down node control transistor, a gate electrode of the second pull-down node control transistor being connected to the pull-up node, the first electrode of the second pull-down node control transistor being connected to the pull-down node, the second electrode of the second pull-down node control transistor being connected to the second level input terminal; a third pull-down node control transistor, a gate electrode and a first electrode of the third pull-down node control transistor being connected to the first level input terminal, a second electrode of the third pull-down node control transistor being connected to the pull-down control node; and a fourth pull-down node control transistor, a gate electrode of the fourth pull-down node control transistor being connected to the pull-down control node, a first electrode of the fourth pull-down node control transistor being connected to the first level input terminal, a second electrode of the fourth pull-down node control transistor being connected to the pull down node.

In some embodiments, the pull-up control node control sub-circuit comprises: a pull-up control transistor, a gate electrode and a first electrode of the pull-up control transistor being connected to the first clock signal input terminal, and a second electrode of the pull-up control transistor being connected to the pull-up control node; a first pull-up control node control transistor, a gate electrode of the first pull-up control node control transistor being connected to the second clock signal input terminal, a first electrode of the first pull-up control node control transistor being connected to the pull-up control node, and a second electrode of the first pull-up control node control transistor being connected to the second level input terminal; and an nth pull-up control node control transistor, a gate electrode of the nth pull-up control node control transistor being connected to the $2n^{th}$ clock signal input terminal, the first electrode of the nth pull-up control node control transistor being connected to the pull-up control node, and the second electrode of the nth pull-up control node control transistor being connected to the second level input terminal.

In some embodiments, the pull-up node control sub-circuit is connected to the first level input terminal and the second level input terminal respectively, configured to control the pull-up node to be connected to the first level input terminal when the potential of the pull-up control node is at the first level, and control the pull-up node to be connected to the second level input terminal when the potential of the pull-down node is a first level and/or the second clock signal input terminal inputs the first level; the start signal output sub-circuit is configured to control the start signal output terminal to be connected to the first level input terminal when the potential of the pull-up node is at a first level, and control the start signal output terminal to be connected to the second level input terminal when the potential of the pull-down node is a first level and/or the second clock signal input terminal inputs a first level.

In some embodiments, the pull-up node control sub-circuit comprises: a first pull-up node control transistor, a gate electrode of the first pull-up node control transistor being connected to the pull-up control node, a first electrode of the first pull-up node control transistor being connected to the first level input terminal, and a second electrode of the first pull-up node control transistor being connected to the pull-up node; a second pull-up node control transistor, a gate electrode of the second pull-up node control transistor being connected to the pull-down node, a first electrode of the second pull-up node control transistor being connected to the pull-up node, and the second electrode of the second pull-up node control transistor being connected to the second level input terminal; and a third pull-up node control transistor, a gate electrode of the third pull-up node control transistor being connected to the second clock signal input terminal, a first electrode of the third pull-up node control transistor being connected to the pull-up node, and a second electrode of the third pull-up node control transistor being connected to the second level input terminal.

In some embodiments, the start signal output sub-circuit comprises: a first start signal output transistor, a gate electrode of the first start signal output transistor being connected to the pull-up node, a first electrode of the first start signal output transistor being connected to the first level input terminal, a second electrode of the first start signal output transistor being connected to the start signal output terminal; a second start signal output transistor, a gate electrode of the second start signal output transistor being connected to the pull-down node, a first electrode of the second start signal output transistor being connected to the start signal output terminal, and a second electrode of the second start signal output transistor being connected to the second level input terminal; and a third start signal output transistor, a gate electrode of the third start signal output transistor being connected to the second clock signal input terminal, a first electrode of the third start signal output transistor being connected to the start signal output terminal, and a second electrode of the third start signal output transistor being connected to the second level input terminal.

In another aspect, a method for driving a start signal generation circuit is provided, the start signal generation circuit provides a start signal to a Gate on Array (GOA) circuit, the GOA circuit is connected to 2N clock signal input terminals, a first level input terminal and a second level input terminal, N is an integer larger than 1, the method comprises: when the first clock signal input terminal inputs the first level and the second clock signal input terminal and the $2n^{th}$ clock signal input terminal input the second level, controlling, by the pull-up control node control sub-circuit, the pull-up control node to be connected to the first clock signal input terminal, and controlling, by the pull-up node control sub-circuit, the potential of the pull-up node to be a first level under the control of voltage signal(s) from the pull-up control node; controlling, by the pull-down node control sub-circuit, the potential of the pull-down node to be a second level under the control of voltage signal(s) from the pull-up node; controlling, by the start signal output sub-circuit, the start signal output terminal to output the first level under the control of voltage signal(s) from the pull-up node and the pull-down node; when the second clock signal input terminal inputs the first level, controlling, by the pull-up control node control sub-circuit, the pull-up control node to be connected to the second level input terminal, and controlling, by the pull-up node control sub-circuit, the potential of the pull-up node to be a second level under control of the pull-up control node and the second clock signal input terminal, and controlling, by the pull-down node control sub-circuit, the potential of the pull-down node to be the first level under the control of voltage signal(s) from the pull-up node, controlling, by the start signal output sub-circuit, the start signal output terminal to output a second level under the control of voltage signal(s) from the pull-up node and the pull-down node; when the $2n^{th}$ clock signal input terminals input the first level, controlling, by the pull-up control node control sub-circuit, the pull-up control node to be connected to the second level input terminal; controlling, by the pull-up node control sub-circuit, the potential of the pull-up node to be maintained at a second level under the control of voltage signal(s) from the pull-up control node; controlling, by the pull-down node control sub-circuit, the potential of the pull-down node to be a first second level under the control of voltage signal(s) from the pull-up node; and controlling, by the start signal output sub-circuit, the start signal output terminal to output a second level under the control of voltage signal(s) from the pull-up node and the pull-down node, where n is an integer larger than 1, and smaller than or equal to N.

In yet another aspect, a gate driving apparatus is provided. It includes a Gate on Array (GOA) circuit and a start signal generation circuit, the start signal generation circuit is connected to the GOA circuit and configured to provide a start signal to the GOA circuit.

Compared with a related art, the start signal generating circuit, the driving method and the display device of the present disclosure can provide a start signal by using terminals required for the operation of the GOA circuit on the existing array substrate, thereby saving space for an additional start signal output terminal and the start signal line.

DETAILED DESCRIPTION

Figure 1:
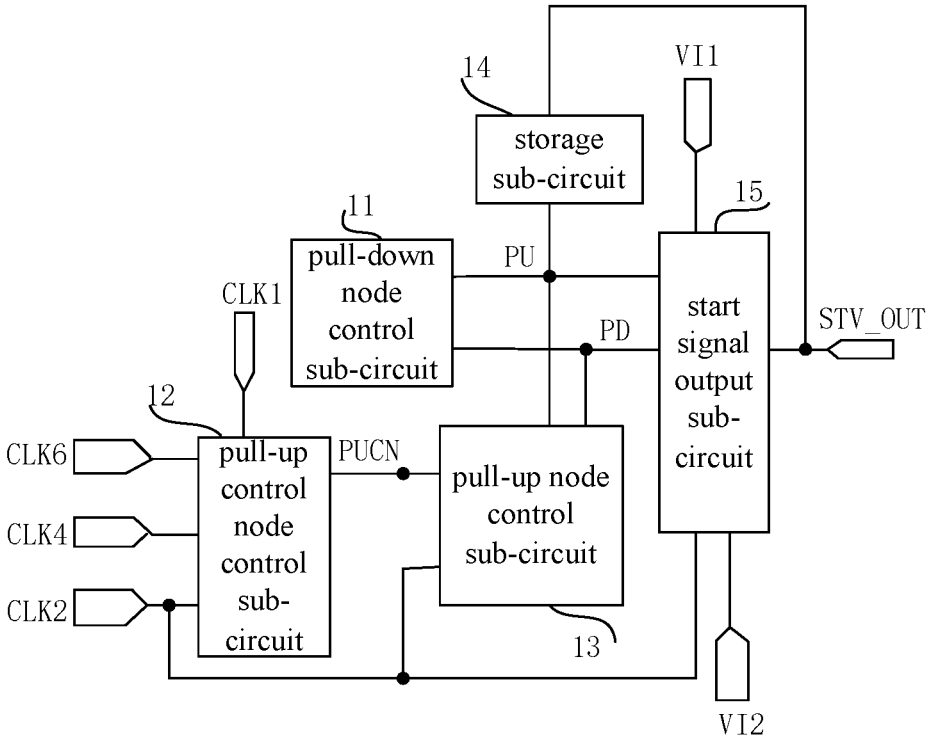
FIG. 1 is a structural diagram of a start signal generation circuit according to an embodiment of the present disclosure.

The technical solutions in the embodiments of the present disclosure are clearly and completely described in the following with reference to the accompanying drawings. It is obvious that the described embodiments are only a part of the embodiments of the present disclosure, and not all of the embodiments. All other embodiments obtained by a person skilled in the art based on the embodiments of the present disclosure without creative work are within the scope of the disclosure.

The transistors in all embodiments of the present disclosure may each be a thin film transistor or a field effect transistor or other devices having the same characteristics. In the embodiment of the present disclosure, in order to distinguish the two electrodes of the transistor other than the gate electrode, one of the electrodes is referred to as a first electrode, and the other electrode is referred to as a second electrode. In some embodiments, the first electrode may be a drain electrode, and the second electrode may be a source electrode; or the first electrode may be a source electrode, and the second electrode may be a drain electrode.

Unless otherwise defined, technical terms or scientific terms used herein shall be understood in the ordinary meaning in the art. The words "first", "second" and similar terms used in the specification and claims of the present disclosure do not denote any order, quantity, or importance, but are merely used to distinguish different components. Similarly, the words "a" or "an" and the like do not denote a quantity limitation, but mean that there is at least one. "Connected", "coupled" and the like are not limited to physical or mechanical connections, but may include electrical connections, directly or indirectly. "Upper", "lower", "left", "right", etc. are only used to indicate the relative positional relationship, and when the absolute position of the object to be described is changed, the relative positional relationship is also changed accordingly.

In some embodiments of the present disclosure, the start signal generation circuit is configured to provide a start signal for the GOA circuit, and the GOA circuit is respectively connected with 2N clock signal input terminals, a first level input terminal, and a second level input terminal, N is an integer greater than one. The start signal generation circuit includes: a pull-down node control sub-circuit, connected to a pull-down node and a pull-up node and configured to control a potential of the pull-down node under the control of voltage signal(s) from the pull-up node; a pull-up control node control sub-circuit, connected to a first clock signal input terminal, a second clock signal input terminal, and the $2n^{th}$ clock signal input terminal and the pull-up control node, and configured to control a potential of the pull-up control node under the control of voltage signal(s) from the first clock signal input terminal, the second clock signal input terminal, the $2n^{th}$ clock signal input terminal and the pull-up control node; a pull-up node control sub-circuit, connected to the pull-up node, the pull-up control node, the pull-down node, and the second clock signal input terminal, and configured to control the a potential of the pull-up node under the control of voltage signal(s) from the pull-up control node, the pull-down node and the second clock signal input terminal; a storage sub-circuit connected between the pull-up node and the start signal output terminal; and a start signal output sub-circuit, connected to the pull-up node, the pull-down node, the second clock signal input terminal, the start signal output terminal, the first level input terminal, and the second level input terminal, and configured to control the start signal output terminal to be connected to the first level input terminal or control the start signal output terminal to be connected to the second level input terminal under the control of voltage signal(s) from the pull-up node, the pull-down node, and the second clock signal input, where n is an integer greater than one and less than or equal to N.

The start signal generation circuit according to the embodiment of the present disclosure can generate a start signal by terminals required by the GOA circuit and arranged on the existing array substrate, that are a clock signal input terminal, a first level input terminal, and a second level input terminal. Therefore, the problem in the related art is solved that an additional start signal output terminal and a start signal line are required.

In the embodiment of the present disclosure, the start signal generation circuit can provide a start signal by using a terminal required for the operation of the GOA circuit on the existing array substrate, thereby saving space for an additional start signal output terminal and a starting signal line.

In some embodiments of the present disclosure, the start signal generation circuit will be described below with reference to the accompanying drawings by taking N equal to 3 as an example.

In some embodiments of the present disclosure, the start signal generation circuit is configured to provide a start signal for the GOA circuit, and the GOA circuit is connected to six clock signal input terminals, the first level input terminal and the second level input terminal. As shown in FIG. 1, the start signal generation circuit includes: a pull-down node control sub-circuit 11 connected to the pull-down node PD and the pull-up node PU, and configured to control a potential of the pull-down node under the control of voltage signal(s) from the pull-up node PU; a pull-up control node control sub-circuit 12, connected to the first clock signal input terminal CLK1, the second clock signal input terminal CLK2, the fourth clock signal input terminal CLK4, the sixth clock signal input terminal CLK6, and the pull-up control node PUCN, configured to control a potential of the pull-up control node PUCN under the control of voltage signal(s) from the first clock signal input terminal CLK1, the second clock signal input terminal CLK2, the fourth clock signal input terminal CLK4, and the sixth clock signal input terminal CLK6; a pull-up node control sub-circuit 13 connected to the pull-up node PU, the pull-up control node PUCN, the pull-down node PD, and the second clock signal input terminal CLK2, and configured to the potential of the pull-up node PU under the control of voltage signal(s) from the pull-up control node PUCN, the pull-down node PD and the second clock signal input terminal CLK2; a storage sub-circuit 14, connected between the pull-up node PU and the start signal output terminal STV_OUT; and a start signal output sub-circuit 15, connected to the pull-up node PU, the pull-down node PD, the second clock signal input terminal CLK2, the start signal output terminal STV_OUT, the first level input terminal VI1 and the second level input terminal VI2, and configured to control the start signal output terminal STV_OUT to be connected to the first level input terminal VI1 or to control the start signal output terminal STV_OUT to be connected to the second level input terminal VI2 under the control of voltage signal(s) from the pull-up node PU, the pull-down node PD and the second clock signal input terminal CLK2.

In some embodiments, when the start signal generation circuit includes transistors that are all n-type transistors, the first level is a high level, and the second level is a low level. When the start signal generation circuit includes transistors that are all p-type transistors, the first level is a low level and the second level is a high level.

Specifically, in a display period of each frame, a period T of a clock signal from each clock signal input terminal is the same, and the current clock signal is delayed by T/2N from an adjacent previous clock signal.

Figure 2:
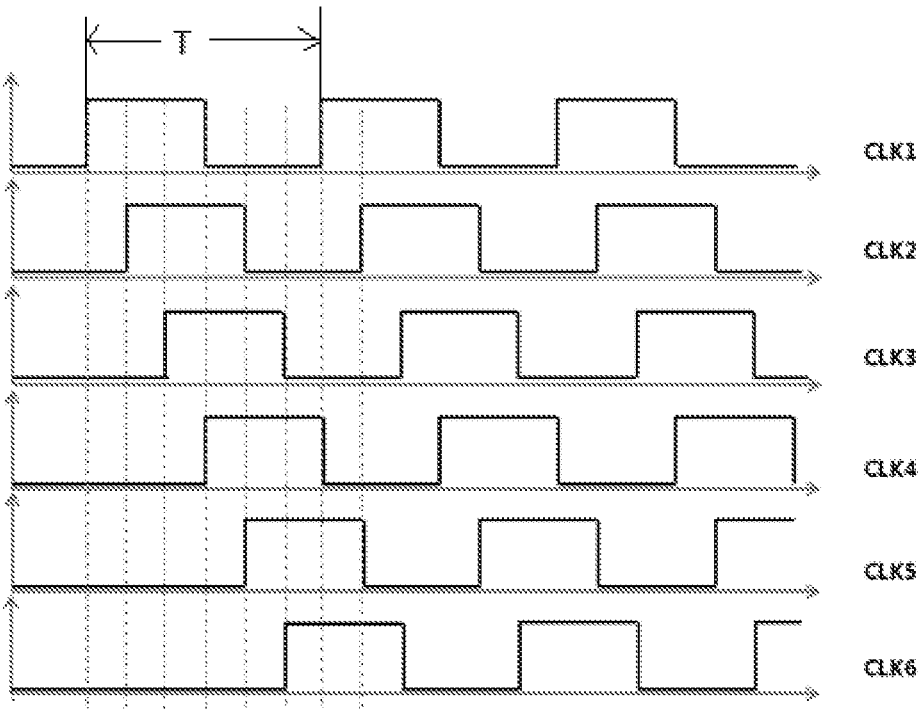
FIG. 2 is a timing chart of respective clock signals when N is equal to 3.

When N is equal to 3, waveforms of CLK1, CLK2, CLK3, CLK4, CLK5, and CLK6 are as shown in FIG. 2. During the display period of each frame, CLK1 and CLK4 are inverted, CLK2 and CLK5 are inverted, and CLK3 and CLK6 are inverted. Phase, periods of CLK1, CLK2, CLK3, CLK4, CLK5, and CLK6 are all T, CLK2 is delayed by T/6 from CLK1, CLK3 is delayed by T/6 from CLK2, and CLK4 is delayed by T/6 from CLK3, CLK5 is delayed by T/6 from CLK4, and CLK6 is delayed by T/6 from CLK5.

In the waveform diagram of the clock signals shown in FIG. 2, the vertical axis is Voltage and the horizontal axis is Time.

The embodiment of the present disclosure is exemplified by N equal to 3, but is not limited thereto. In some optional embodiments, N may be any integer greater than or equal to 2.

In some embodiments, the pull-down node control sub-circuit is further connected to the first level input terminal and the second level input terminal, respectively, and configured to control the pull-down node to be connected to the second level input terminal when the potential of the pull-up node is at a first level, and control the pull-down node to be connected to the first level input terminal when the potential of the pull-up node is at a second level. The pull-up control node control sub-circuit is connected to the second level input terminal, and configured to control a pull-up control node to be connected to the first clock signal input terminal when the first clock signal input terminal inputs a first level, and the second clock signal input terminal and the $2n^{th}$ clock signal input terminal all input a second level, and to control the pull-up node to be connected to the second level input terminal when the second clock signal input terminal inputs a first level and/or the $2n^{th}$ clock signal input terminal inputs a first level.

In some embodiments, the pull-up node control sub-circuit is further connected to the first level input terminal and the second level input terminal respectively, configured to control the pull-up node to be connected to the first level input terminal when the potential of the pull-up control node is the first level, and control the pull-up node to be connected to the second level input terminal when the potential of the pull-down node is a first level and/or the second clock signal input terminal inputs the first level. The start signal output sub-circuit is configured to control the start signal output terminal to be connected to the first level input terminal when the potential of the pull-up node is at a first level, and control the start signal output terminal to be connected to the second level input terminal when the potential of the pull-down node is a first level and/or the second clock signal input terminal inputs a first level.

Figure 3:
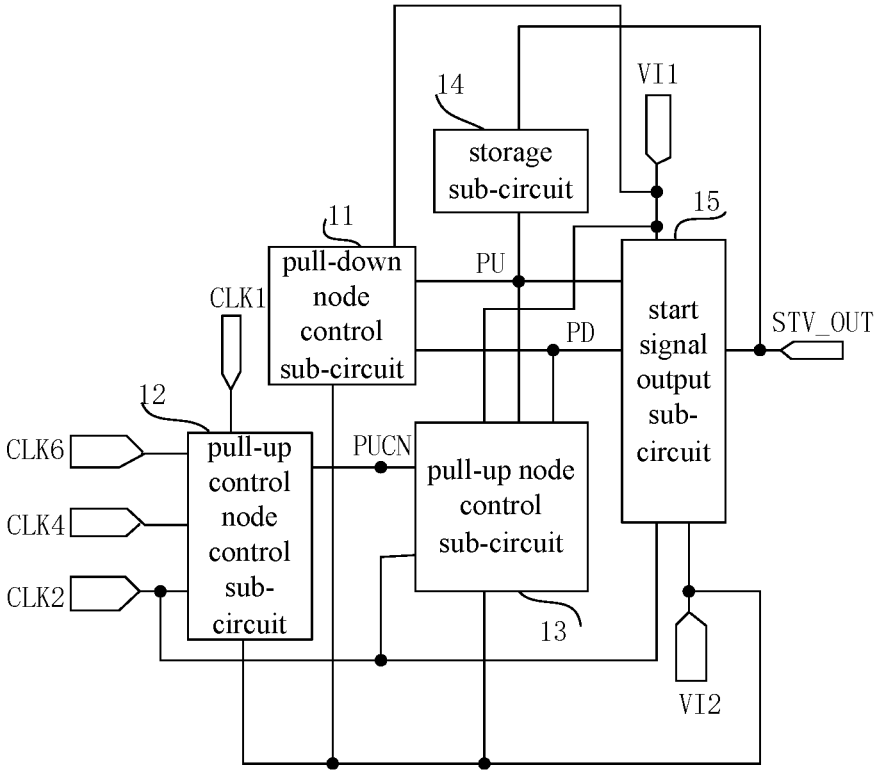
FIG. 3 is a structural diagram of a start signal generation circuit according to another embodiment of the present disclosure.

As shown in FIG. 3, on the basis of the embodiment of the start signal generation circuit shown in FIG. 2, the pull-down node control sub-circuit 11 is also connected to the first level input terminal VI1 and the second level input terminal VI2, respectively, and configured to control the pull-down node PD to be connected to the second level input terminal VI2 when the potential of the pull-up node PU is at a first level, and control the pull-down node PD to be connected to the first level input terminal VI1 when the potential of the pull-up node PU is at a second level. The pull-up control node control sub-circuit 12 is also connected to the second level input terminal VI2, configured to control the pull-up control node PUCN to be connected to the first clock signal input terminal CLK1 when the first clock signal input terminal CLK1 inputs the first level, the second clock signal input terminal CLK2, the fourth clock signal input terminal CLK4, and the sixth clock signal input terminal CLK6 all input the second level, and configured to control the pull-up control node PUCN to be connected to the second level input terminal VI2 when at least one of the second clock signal input terminal CLK2, the fourth clock signal input terminal CLK4, and the sixth clock signal input terminal CLK6 input the first level The terminal CLK1 is connected. The pull-up node control sub-circuit 13 is further connected to the first level input terminal VI1 and the second level input terminal VI2, configured to control the pull-up node PU to be connected to the first level input terminal VI1 when the potential of the pull-up control node PUCN is at a first level, and control the pull-up node PU to be connected to the second level input terminal VI2 when the potential of the pull-down node PD is a first level and/or the second clock signal input terminal CLK2 inputs a first level. The start signal output sub-circuit 15 is specifically configured to control the start signal output terminal STV_OUT to be connected to the first level input terminal VI1 when the potential of the pull-up node PU is at a first level, and control the start signal output STV_OUT to be connected to the second level input terminal VI2 when the potential of the pull-down node PD is at a first level and/or the second clock signal input terminal CLK2 inputs a first level.

Figure 4:
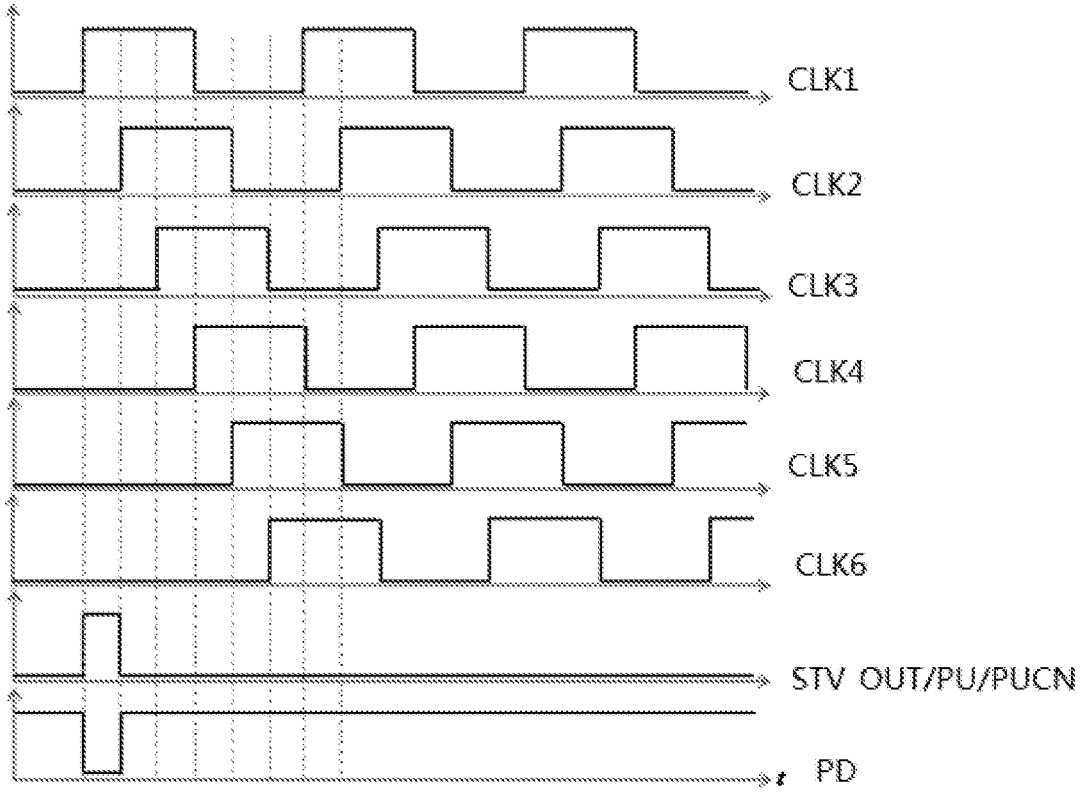
FIG. 4 is a timing chart showing an operation of a start signal generation circuit according to an embodiment of the present disclosure.

As shown in FIG. 4, the start signal generation circuit shown in FIG. 3 is in operation (assuming that the first level is a high level and the second level is a low level).

When the first clock signal input terminal CLK1 inputs a high level and the second clock signal input terminal CLK2, the fourth clock signal input terminal CLK4, and the sixth clock signal input terminal CLK6 all input a low level, the pull-up control node control sub-circuit 12 controls the pull-up control node PUCN to be connected to the first clock signal input terminal CLK1, so that the potential of the PUCN is at a high level. The pull-up node control sub-circuit 13 controls the potential of the pull-up node PU to be a high level under the control of voltage signal(s) from the pull-up control node PUCN, the pull-down node control sub-circuit 11 controls the potential of the pull-down node PD to be a low level under the control of voltage signal(s) from the pull-up node PU; the start signal output sub-circuit 15 controls the start signal output terminal STV_OUT to output a high level under the control of voltage signal(s) from the pull-up node PU and the pull-down node PD.

When the second clock signal input terminal CLK2 inputs a high level, the pull-up control node control sub-circuit 12 controls the pull-up control node PUCN to be connected to the second level input terminal VI2, so that the potential of the PUCN is a low level. The pull-up node control sub-circuit 13 controls the potential of the pull-up node PU to be a low level under the control of voltage signal(s) from the pull-up control node PUCN and the second clock signal input terminal CLK2. The pull-down node control sub-circuit 11 controls the potential of the pull-down node PD to be a high level under the control of voltage signal(s) from the pull-up node PU. The start signal output sub-circuit 15 controls the start signal output terminal STV_OUT to output a low level under the control of voltage signal(s) from the pull-up node PU and the pull-down node PD.

When the fourth clock signal input terminal CLK4 and/or the sixth clock signal input terminal CLK6 input a high level, the pull-up control node control sub-circuit 12 continues to control the pull-up control node PUCN to be connected to the second level input terminal VI2, so that the potential of the PUCN is at a low level. The pull-up node control sub-circuit 13 controls the potential of the pull-up node PU to be maintained at a low level under the control of voltage signal(s) from the pull-up control node PUCN. The pull-down node control sub-circuit 11 controls the potential of the pull-down node PD to be a high level under the control of voltage signal(s) from the pull-up node PU. The start signal output sub-circuit 15 controls the start signal output terminal STV_OUT to output a low level under the control of voltage signal(s) from the pull-up node PU and the pull-down node PD.

Specifically, the pull-down node control sub-circuit may include: a first pull-down node control transistor, a gate electrode thereof being connected to the pull-up node, a first electrode thereof being connected to the pull-down control node, a second electrode thereof being connected to the second level input terminal; a second pull-down node control transistor, a gate electrode thereof being connected to the pull-up node, the first electrode thereof being connected to the pull-down node, the second electrode thereof being connected to the second level input terminal; a third pull-down node control transistor, a gate electrode and a first electrode thereof being both connected to the first level input terminal, a second electrode thereof being connected to the pull-down control node; and a fourth pull-down node control transistor, a gate electrode thereof being connected to the pull-down control node, a first electrode thereof being connected to the first level input terminal, a second electrode thereof being connected to the pull down node.

Specifically, the pull-up control node control sub-circuit may include: a pull-up control transistor, a gate electrode and a first electrode thereof being connected to the first clock signal input terminal, and a second electrode thereof being connected to the pull-up control node; a first pull-up control node control transistor, a gate electrode thereof being connected to the second clock signal input terminal, a first electrode thereof being connected to the pull-up control node, and a second electrode thereof being connected to the second level input terminal; and an $n^{th}$ pull-up control node control transistor, a gate electrode being connected to the $2n^{th}$ clock signal input terminal, the first electrode thereof being connected to the pull-up control node, and the second electrode thereof being connected to the second level input terminal.

Specifically, the pull-up node control sub-circuit may include: a first pull-up node control transistor, a gate electrode thereof being connected to the pull-up control node, a first electrode thereof being connected to the first level input terminal, and a second electrode thereof being connected to the pull-up node; a second pull-up node control transistor, a gate electrode thereof being connected to the pull-down node, a first electrode thereof being connected to the pull-up node, and the second electrode thereof being connected to the second level input terminal; and a third pull-up node control transistor, a gate electrode thereof being connected to the second clock signal input terminal, a first electrode thereof being connected to the pull-up node, and a second electrode thereof being connected to the second level input terminal.

Specifically, the start signal output sub-circuit may include: a first start signal output transistor, a gate electrode thereof being connected to the pull-up node, a first electrode thereof being connected to the first level input terminal, a second electrode thereof being connected to the start signal output terminal; a second start signal output transistor, a gate electrode thereof being connected to the pull-down node, a first electrode thereof being connected to the start signal output terminal, and a second electrode thereof being connected to the second level input terminal; and a third start signal output transistor, a gate electrode thereof being connected to the second clock signal input terminal, a first electrode thereof being connected to the start signal output terminal, and a second electrode thereof being connected to the second level input terminal.

The start signal generation sub-circuit of the present disclosure will be described below.

Figure 5:
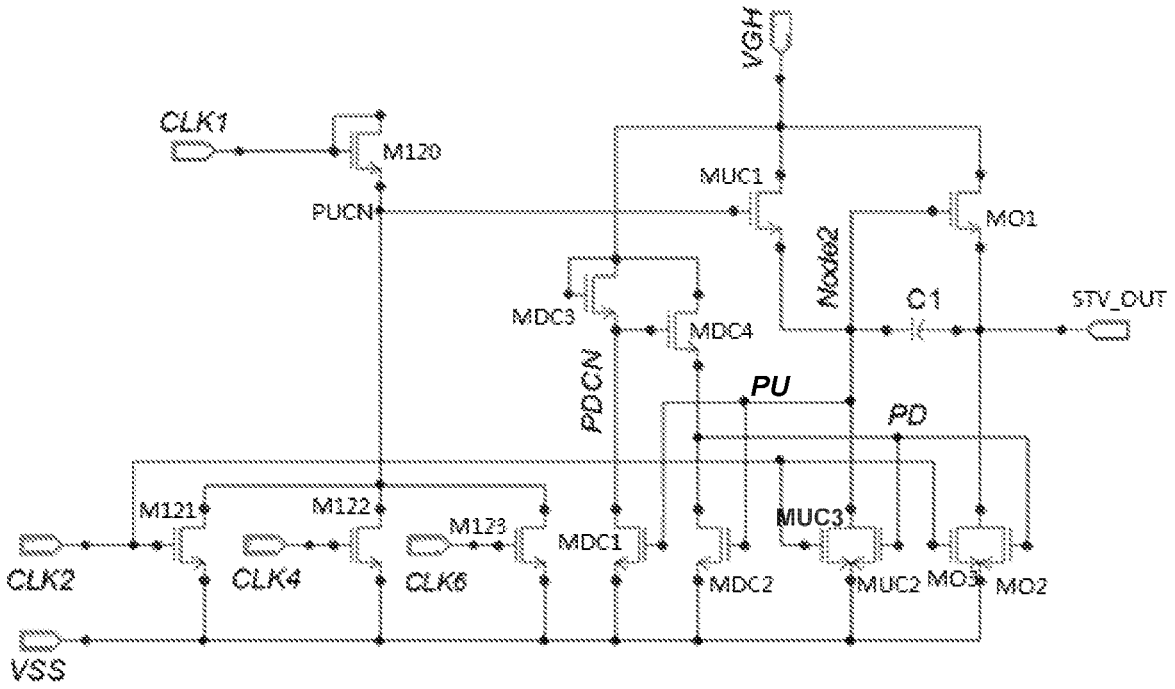
FIG. 5 is a circuit diagram of a start signal generation circuit of the present disclosure.

As shown in FIG. 5, the start signal generation sub-circuit of the present disclosure includes a pull-down node control sub-circuit, a pull-up control node control sub-circuit, a pull-up node control sub-circuit, a storage sub-circuit, and a start signal output sub-circuit.

The pull-down node control sub-circuit includes: a first pull-down node control transistor MDC1, a gate electrode thereof being connected to the pull-up node PU, a drain electrode thereof being connected to the pull-down control node PDCN, and a source electrode thereof being connected to the low-level input terminal VSS; a second pull-down node control transistor MDC2, a gate electrode thereof being connected to the pull-up node PU, a drain electrode thereof being connected to the pull-down node PD, a source electrode thereof being connected to the low-level input terminal VSS; a third pull-down node control transistor MDC3, a gate electrode and a drain electrode thereof being connected to the high-level input terminal VGH, a source electrode thereof being connected to the pull-down control node PDCN; and a fourth pull-down node control transistor MDC4, a gate electrode thereof being connected to the pull-down control node PDCN, and a drain electrode thereof being connected to the high-level input terminal VGH, and a source electrode thereof being connected to the pull-down node PD.

The pull-up control node control sub-circuit may include: a pull-up control transistor M120, a gate electrode and a drain electrode thereof being both connected to the first clock signal input terminal CLK1, and a source electrode thereof being connected to the pull-up control node PUCN; a first pull-up control node control transistor M121, a gate electrode thereof being connected to the second clock signal input terminal CLK2, a drain electrode thereof being connected to the pull-up control node PUCN, and a source electrode thereof being connected to the low level input terminal VSS; a second pull-up control node control transistor M122, a gate electrode thereof being connected to the fourth clock signal input terminal CLK4, a drain thereof being connected to the pull-up control node PUCN, a source electrode thereof being connected to the low level input terminal VSS; and a third pull-up control node control transistor M123, a gate electrode thereof being connected to a sixth clock signal input terminal CLK6, a drain electrode thereof being connected to the pull-up control node PUCN, and a source electrode thereof being connected to the low level input terminal VSS.

The pull-up node control sub-circuit includes: a first pull-up node control transistor MUC1, a gate electrode thereof being connected to the pull-up control node PUCN, a drain electrode thereof being connected to a high-level input terminal VGH, a source electrode thereof being connected to the pull-up node PU; a second pull-up node control transistor MUC2, a gate electrode thereof being connected to the pull-down node PD, a drain electrode thereof being connected to the pull-up node PU, a source electrode thereof being connected to the low-level input terminal VSS; and a third pull-up node control transistor MUC3, a gate electrode thereof being connected to the second clock signal input terminal CLK2, a drain electrode thereof being connected to the pull-up node PU, and a source electrode thereof being connected to the low-level input terminal VSS.

The start signal output sub-circuit includes: a first start signal output transistor MO1, a gate electrode thereof being connected to the pull-up node PU, a drain electrode thereof being connected to the high-level input terminal VGH, a source electrode thereof being connected to the start signal output terminal STV_OUT; a second start signal output transistor MO2, a gate electrode thereof being connected to the pull-down node PD, a drain electrode thereof being connected to the start signal output terminal STV_OUT, a source electrode thereof being connected to the low-level input terminal VSS; and a third start signal output transistor MO3, a gate electrode thereof being connected to the second clock signal input terminal CLK2, a drain electrode thereof being connected to the start signal output terminal STV_OUT, and a source electrode thereof being connected to the low level input terminal VSS. The storage sub-circuit includes: a storage capacitor C1, connected between the pull-up node PU and the start signal output terminal STV_OUT.

In the embodiment shown in FIG. 5, all of the transistors are n-type transistors. In some alternative embodiments, the transistors can also be p-type transistors. The timing of each clock signal needs to be inverted, the first level is set to be a low level and the second level is set to be a high level.

As shown in FIG. 4, in the specific embodiment of the start signal generation circuit shown in FIG. 5, before the CLK1 inputs a high level, MDC3 and MDC4 are turned on and the potential of the PDCN and the potential of the PD are at a high level, MU2 and MO2 are turned on, the potential of PU is at a low level, STV_OUT outputs a low level. When CLK1 inputs a high level, CLK2, CLK4 and CLK6 all input a low level, M120 and MU1 are both turned on, the potential of PU becomes a high level, MDC1 and MDC2 are both turned on, the potentials of PDCN and PD are both at a low level, MO1 is turned on, STV_OUT outputs a high level; STV_OUT starts to output a high level at beginning of a frame. When CLK2 inputs a high level, M121, MU3 and MO3 are all turned on, the potentials of PUCN and PU are all ate a low level, STV_OUT outputs a low level, MDC1 and MDC2 are both turned off, the potential of PD is restored to a high level, PU and STV_OUT are continually reset so as to prevent STV_OUT from outputting a high level. When CLK4 inputs a high level, M122 is turned on to pull down the potential of PUCN, so as to prevent MU1 from being turned on when CLK1 is at a high level, so that STV_OUT outputs a low level. When CLK6 inputs a high level, M123 is turned on, the potential of PUCN is pulled down so as to prevent MU1 from being turned on when CLK1 inputs a high level, so that STV_OUT outputs a low level. The above procedure is repeated when the next frame is displayed.

From the above, only when CLK1 inputs a high level and CLK2, CLK4 and CLK6 all input a low level, the potential of the start signal from STV_OUT will be a high level, that is, the beginning time of each frame. When the start signal is at a high level, the potential of the pull-up node PU of the first row of GOA sub-circuits included in the GOA circuit that receives the start signal is pulled up to a high level, so as to ensure normal output of the GOA circuit. It should be noted that the first clock signal received by the first row of GOA sub-circuits and the potential of the pull-up node PU in the first row of GOA sub-circuits become a high level simultaneously, and the gate drive signal outputted by the first row of GOA sub-circuits is maintained in a high level for a longer time period, but the normal output of the next row of GOA sub-circuits is not adversely affected. In some alternative embodiments, the first row of GOA sub-circuits can be set to Dummy (pseudo) GOA sub-circuit, that is, the first row of GOA sub-circuits do not drive a gate line.

A method for driving the start signal generation circuit according to the embodiment of the present disclosure is applied to the above-described start signal generation circuit, and the start signal generation circuit is configured to provide a start signal for the GOA circuit, and the GOA circuit is respectively connected to 2N clock signal input terminals, the first level input terminal and the second level input terminal, where N is an integer greater than 1. The driving method comprises the following steps.

When the first clock signal input terminal inputs the first level and the second clock signal input terminal and the $2n^{th}$ clock signal input terminal both input the second level, the pull-up control node control sub-circuit controls the pull-up control node to be connected to the first clock signal input terminal, and the pull-up node control sub-circuit controls the potential of the pull-up node to be a first level under the control of voltage signal(s) from the pull-up control node; the pull-down node control sub-circuit controls the potential of the pull-down node to be a second level under the control of voltage signal(s) from the pull-up node; the start signal output sub-circuit controls the start signal output terminal to output the first level under the control of voltage signal(s) from the pull-up node and the pull-down node.

When the second clock signal input terminal inputs the first level, the pull-up control node control sub-circuit controls the pull-up control node to be connected to the second level input terminal, and the pull-up node control sub-circuit controls the potential of the pull-up node to be a second level under control of the pull-up control node and the second clock signal input terminal, and the pull-down node control sub-circuit controls the potential of the pull-down node to be the first level under the control of voltage signal(s) from the pull-up node, the start signal output sub-circuit controls the start signal output terminal to output a second level under the control of voltage signal(s) from the pull-up node and the pull-down node.

When the 2n clock signal input terminals input the first level, the pull-up control node control sub-circuit continues to control the pull-up control node to be connected to the second level input terminal, and the pull-up node control sub-circuit controls the potential of the pull-up node to be maintained at a second level under the control of voltage signal(s) from the pull-up node, the start signal output sub-circuit controls the start signal output terminal to output a second level under the control of voltage signal(s) from the pull-up node and the pull-down node.

Where n is an integer greater than 1 and less than or equal to N.

A gate driving apparatus according to an embodiment of the present disclosure includes a GOA circuit, and above-described start signal generation circuit; the start signal generation circuit is connected to the GOA circuit and configured to provide a start signal for the GOA circuit.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A start signal generation circuit for providing a start signal to a Gate on Array (GOA) circuit, wherein the GOA circuit is connected to 2N clock signal input terminals, a first level input terminal and a second level input terminal, N is an integer larger than 1, the start signal generation circuit comprises:

a pull-down node control sub-circuit, connected to a pull-down node and a pull-up node respectively, and configured to control a potential of the pull-down node under the control of a voltage signal from the pull-up node;

a pull-up control node control sub-circuit, connected to a first clock signal input terminal, a second clock signal input terminal, a $2n^{th}$ clock signal input terminal, and a pull-up control node, configured to control a potential of the pull-up control node under the control of voltage signals from the first clock signal input terminal, the second clock signal input terminal, and the $2n^{th}$ clock signal input terminal;

a pull-up node control sub-circuit, connected to the pull-up node, the pull-up control node, the pull-down node, and the second clock signal input terminal, and configured to control the potential of the pull-up node under the control of voltage signals from the pull-up control node, the pull-down node and the second clock signal input terminal;

a storage sub-circuit, connected between the pull-up node PU and a start signal output terminal; and a start signal output sub-circuit, connected to the pull-up node, the pull-down node, the second clock signal input terminal, the start signal output terminal, the first level input terminal and the second level input terminal, and configured to control the start signal output terminal to be connected to the first level input terminal or to control the start signal output terminal to be connected to the second level input terminal under the control of voltage signals from the pull-up node, the pull-down node and the second clock signal input terminal.

2. The start signal generation circuit according to claim 1, wherein in a display period of each frame, a period of a clock signal from each clock signal input terminal is the same, and a current clock signal is delayed by T/2N from an adjacent previous clock signal.

3. The start signal generation circuit according to claim 2, wherein the pull-down node control sub-circuit is connected to the first level input terminal and the second level input terminal respectively, and configured to control the pull-down node to be connected to the second level input terminal when the potential of the pull-up node is at a first level, and control the pull-down node to be connected to the first level input terminal when the potential of the pull-up node is at a second level; the pull-up control node control sub-circuit is connected to the second level input terminal, and configured to control a pull-up control node to be connected to the first clock signal input terminal when the first clock signal input terminal inputs the first level, and the second clock signal input terminal and the 2n* clock signal input terminal all input the second level, and to control the pull-up node to be connected to the second level input terminal when the second clock signal input terminal inputs the first level and/or the $2n^{th}$ clock signal input terminal inputs the first level.

4. The start signal generation circuit according to claim 2, the pull-up node control sub-circuit is connected to the first level input terminal and the second level input terminal respectively, configured to control the pull-up node to be connected to the first level input terminal when the potential of the pull-up control node is at the first level, and control the pull-up node to be connected to the second level input terminal when the potential of the pull-down node is a first level and/or the second clock signal input terminal inputs the first level; the start signal output sub-circuit is configured to control the start signal output terminal to be connected to the first level input terminal when the potential of the pull-up node is at the first level, and control the start signal output terminal to be connected to the second level input terminal when the potential of the pull-down node is the first level and/or the second clock signal input terminal inputs the first level.

5. The start signal generation circuit according to claim 1, wherein the pull-down node control sub-circuit is connected to the first level input terminal and the second level input terminal respectively, and configured to control the pull-down node to be connected to the second level input terminal when the potential of the pull-up node is at a first level, and control the pull-down node to be connected to the first level input terminal when the potential of the pull-up node is at a second level; the pull-up control node control sub-circuit is connected to the second level input terminal, and configured to control a pull-up control node to be connected to the first clock signal input terminal when the first clock signal input terminal inputs the first level, and the second clock signal input terminal and the 2n* clock signal input terminal all input the second level, and to control the pull-up node to be connected to the second level input terminal when the second clock signal input terminal inputs the first level and/or the $2n^{th}$ clock signal input terminal inputs the first level.

6. The start signal generation circuit according to claim 5, wherein the pull-down node control sub-circuit comprises:

a first pull-down node control transistor, a gate electrode of the first pull-down node control transistor being connected to the pull-up node, a first electrode of the first pull-down node control transistor being connected to the pull-down control node, a second electrode of the first pull-down node control transistor being connected to the second level input terminal;

a second pull-down node control transistor, a gate electrode of the second pull-down node control transistor being connected to the pull-up node, the first electrode of the second pull-down node control transistor being connected to the pull-down node, the second electrode of the second pull-down node control transistor being connected to the second level input terminal;

a third pull-down node control transistor, a gate electrode and a first electrode of the third pull-down node control transistor being connected to the first level input terminal, a second electrode of the third pull-down node control transistor being connected to the pull-down control node; and a fourth pull-down node control transistor, a gate electrode of the fourth pull-down node control transistor being connected to the pull-down control node, a first electrode of the fourth pull-down node control transistor being connected to the first level input terminal, a second electrode of the fourth pull-down node control transistor being connected to the pull down node.

7. The start signal generation circuit according to claim 5, wherein the pull-up control node control sub-circuit comprises:

a pull-up control transistor, a gate electrode and a first electrode of the pull-up control transistor being connected to the first clock signal input terminal, and a second electrode of the pull-up control transistor being connected to the pull-up control node;

a first pull-up control node control transistor, a gate electrode of the first pull-up control node control transistor being connected to the second clock signal input terminal, a first electrode of the first pull-up control node control transistor being connected to the pull-up control node, and a second electrode of the first pull-up control node control transistor being connected to the second level input terminal; and an $n^{th}$ pull-up control node control transistor, a gate electrode of the $n^{th}$ pull-up control node control transistor being connected to the $2n^{th}$ clock signal input terminal, the first electrode of the $n^{th}$ pull-up control node control transistor being connected to the pull-up control node, and the second electrode of the $n^{th}$ pull-up control node control transistor being connected to the second level input terminal.

8. The start signal generation circuit according to claim 1, the pull-up node control sub-circuit is connected to the first level input terminal and the second level input terminal respectively, configured to control the pull-up node to be connected to the first level input terminal when the potential of the pull-up control node is at the first level, and control the pull-up node to be connected to the second level input terminal when the potential of the pull-down node is a first level and/or the second clock signal input terminal inputs the first level; the start signal output sub-circuit is configured to control the start signal output terminal to be connected to the first level input terminal when the potential of the pull-up node is at the first level, and control the start signal output terminal to be connected to the second level input terminal when the potential of the pull-down node is the first level and/or the second clock signal input terminal inputs the first level.

9. The start signal generation circuit according to claim 8, wherein the pull-up node control sub-circuit comprises:

a first pull-up node control transistor, a gate electrode of the first pull-up node control transistor being connected to the pull-up control node, a first electrode of the first pull-up node control transistor being connected to the first level input terminal, and a second electrode of the first pull-up node control transistor being connected to the pull-up node;

a second pull-up node control transistor, a gate electrode of the second pull-up node control transistor being connected to the pull-down node, a first electrode of the second pull-up node control transistor being connected to the pull-up node, and the second electrode of the second pull-up node control transistor being connected to the second level input terminal; and a third pull-up node control transistor, a gate electrode of the third pull-up node control transistor being connected to the second clock signal input terminal, a first electrode of the third pull-up node control transistor being connected to the pull-up node, and a second electrode of the third pull-up node control transistor being connected to the second level input terminal.

10. The start signal generation circuit according to claim 8, wherein the start signal output sub-circuit comprises:

a first start signal output transistor, a gate electrode of the first start signal output transistor being connected to the pull-up node, a first electrode of the first start signal output transistor being connected to the first level input terminal, a second electrode of the first start signal output transistor being connected to the start signal output terminal;

a second start signal output transistor, a gate electrode of the second start signal output transistor being connected to the pull-down node, a first electrode of the second start signal output transistor being connected to the start signal output terminal, and a second electrode of the second start signal output transistor being connected to the second level input terminal; and a third start signal output transistor, a gate electrode of the third start signal output transistor being connected to the second clock signal input terminal, a first electrode of the third start signal output transistor being connected to the start signal output terminal, and a second electrode of the third start signal output transistor being connected to the second level input terminal.

11. A method for driving a start signal generation circuit according to claim 1, wherein the method comprises: when the first clock signal input terminal inputs the first level and the second clock signal input terminal and a 2n* clock signal input terminal input the second level, controlling, by the pull-up control node control sub-circuit, the pull-up control node to be connected to the first clock signal input terminal, and controlling, by the pull-up node control sub-circuit, the potential of the pull-up node to be a first level under the control of a voltage signal from the pull-up control node; controlling, by the pull-down node control sub-circuit, the potential of the pull-down node to be a second level under the control of the voltage signal from the pull-up node; controlling, by the start signal output sub-circuit, the start signal output terminal to output the first level under the control of voltage signals from the pull-up node and the pull-down node; when the second clock signal input terminal inputs the first level, controlling, by the pull-up control node control sub-circuit, the pull-up control node to be connected to the second level input terminal, and controlling, by the pull-up node control sub-circuit, the potential of the pull-up node to be the second level under control of the pull-up control node and the second clock signal input terminal, and controlling, by the pull-down node control sub-circuit, the potential of the pull-down node to be the first level under the control of the voltage signal from the pull-up node, controlling, by the start signal output sub-circuit, the start signal output terminal to output the second level under the control of the voltage signals from the pull-up node and the pull-down node; when the 2n* clock signal input terminal input the first level, controlling, by the pull-up control node control sub-circuit, the pull-up control node to be connected to the second level input terminal; controlling, by the pull-up node control sub-circuit, the potential of the pull-up node to be maintained at the second level under the control of a voltage signal from the pull-up control node; controlling, by the pull-down node control sub-circuit, the potential of the pull-down node to be a first level under the control of the voltage signal from the pull-up node; and controlling, by the start signal output sub-circuit, the start signal output terminal to output the second level under the control of the voltage signal from the pull-up node and the pull-down node, where n is an integer larger than 1, and smaller than or equal to N.

12. A gate driving apparatus comprising a Gate on Array (GOA) circuit and a start signal generation circuit according to claim 1, wherein the start signal generation circuit is connected to the GOA circuit and configured to provide a start signal to the GOA circuit.

* * * * *